US005852452A

United States Patent [19]

Imai

[11] Patent Number: 5,852,452

[45] Date of Patent: Dec. 22, 1998

[54] INK JET PRINTER WITH ADJUSTABLE CAPPING MECHANISM AND PRINTING CAP

[75] Inventor: Koji Imai, Nagoya, Japan

[73] Assignee: Brother Kogyo Kabushiki Kaisha, Nagoya, Japan

[21] Appl. No.: 872,960

[22] Filed: Jun. 12, 1997

[30] Foreign Application Priority Data

Jul. 25, 1996 [JP] Japan ..... 8-195799

[51] Int. Cl.[6] ..... B41J 25/308; B41J 2/165

[52] U.S. Cl. ..... 347/8; 347/30; 347/32

[58] Field of Search ..... 400/56, 57, 59; 347/8, 23, 29, 30, 32

[56] References Cited

U.S. PATENT DOCUMENTS

| | | | |
|---|---|---|---|
| 4,676,675 | 6/1987 | Suzuki et al. | 400/56 |
| 5,067,835 | 11/1991 | Yamamoto et al. | 400/624 |
| 5,156,464 | 10/1992 | Sakai | 400/56 |
| 5,187,497 | 2/1993 | Hirano et al. | 347/8 |
| 5,479,194 | 12/1995 | Hirano et al. | 347/22 |
| 5,563,637 | 10/1996 | Francis et al. | 347/32 |
| 5,576,744 | 11/1996 | Nikura et al. | 347/8 |
| 5,610,636 | 3/1997 | Hanabusa et al. | 400/56 |

FOREIGN PATENT DOCUMENTS

A-8-207388 8/1996 Japan .

*Primary Examiner*—Edgar Burr
*Assistant Examiner*—Daniel J. Corilla
*Attorney, Agent, or Firm*—Oliff & Berridge, PLC

[57] ABSTRACT

A voltage output based on the resistance, which is determined by how a contact member on an adjusting lever is connected to a resistance member on the side of a carriage, is detected as a head gap. The cap advancing/retracing distance during capping operation by a capping mechanism is adjusted according to the detected head gap. Consequently, the capping operation of the cap to hermetically cover a nozzle surface of a print head is performed effectively.

24 Claims, 11 Drawing Sheets

Fig. 11

| RECORDING MEDIUM | OUTPUT VOLTAGE | CAM ROTATIONAL ANGLE | PRINT DENSITY | FEEDING AMOUNT PER CARRIAGE RETURN |
|---|---|---|---|---|
| ENVELOPE | 0V | $\theta 2$ | HIGH | 0.5mm |
| OHP SHEET | 1.7V | $\theta 2+(\theta 1-\theta 2)\times 1/3$ | LOW | 0.25mm |
| PLAIN PAPER | 3.4V | $\theta 2+(\theta 1-\theta 2)\times 2/3$ | NORMAL | 1mm |
| TRACING PAPER | 5V | $\theta 1$ | LOW | 0.5mm |

INK JET PRINTER WITH ADJUSTABLE CAPPING MECHANISM AND PRINTING CAP

BACKGROUND OF THE INVENTION

1. Field of the Invention

This invention relates to a printer which ejects ink to a recording medium and thereby produces a printed record.

2. Description of Related Art

Generally, an ink-jet printer which produces a printed record by ejecting ink to a recording medium has, within its body case, a recorder replaceably equipped with an ink-jet print head and an ink cartridge containing ink supplied to the print head, a feeder which feeds the recording medium, and a carriage which moves reciprocatingly the recorder according to the size of the recording medium fed by the feeder.

To obtain good quality printing regardless of the thickness of the printing medium in such an ink-jet printer, there has conventionally been provided gap indicating means for indicating a head gap which is an interval between the print head and a recording medium. When the operator indicates the head gap, a gap adjusting mechanism adjusts the actual head gap by moving the print head according to the indicated head gap.

In addition, to maintain a good condition of ink ejection from the print head, there has conventionally been provided a suction cap which covers the print head and a recovery unit which removes ink by suction from the print head.

However, if the print head position is changed when the head gap is adjusted by the gap adjusting mechanism according to the thickness of the printing medium, the interval between the suction cap and the print head is changed as well. In particular, when the print head is moved away from the printing medium to adjust the head gap, the interval between the suction cap and the print head becomes greater, and accordingly the hermeticity of the suction cap covering a nozzle surface of the print head is reduced, disabling effective ink suction and an adequate print head recovery operation.

SUMMARY OF THE INVENTION

In view of the foregoing disadvantage, an object of the invention is to provide a printer in which the head gap can be adjusted without affecting the print head recovery operation.

According to a first aspect of the invention, a printer comprises a print head which ejects ink to a recording medium to produce a printed record, a capping mechanism which has a cap hermetically covering a nozzle surface of the print head and brings the cap into contact with the nozzle surface of the print head in such a manner that the cap can advance/retract, gap indicating means for indicating a head gap which is an interval between the print head and the recording medium, and a gap adjusting mechanism adjusting the actual head gap to the indicated head gap. The printer further comprises head gap detecting means for detecting the head gap indicated by the gap indicating means and cap position adjusting means for receiving signals from the head gap detecting means, for controlling the capping mechanism, and for adjusting the cap advancing/retracting distance during capping operation by the capping mechanism.

In the first aspect of the invention, as described above, the capping mechanism is controlled by the cap position adjusting means, and thereby the cap advancing/retracting distance during the capping operation by the capping mechanism is adjusted. Therefore, the capping operation is performed in approximately the same condition at all times regardless of the head gap.

According to a second aspect of the invention, the cap is a suction cap designed to perform the print head recovery operation and the printer further comprises a recovery unit which removes ink by suction from the print head while bringing the suction cap into contact with the nozzle surface of the print head. Therefore, the recovery operation can be performed in a constantly good condition.

According to a third aspect of the invention, the gap indicating means is an adjusting lever whose rotational angle determines the head gap, and the gap adjusting mechanism consists of a cam mechanism which interlocks the adjusting lever and advances/retracts the print head to/from the recording medium. Therefore, the head gap can be adjusted by rotating the adjusting lever.

In a fourth aspect of the invention, since the head gap detecting means detects the rotational angle of the adjusting lever as an electrical resistance and detects the head gap based on the electrical resistance, the head gap can be easily detected.

In a fifth aspect of the invention, the cap position adjusting means has a cam member linked with the cap and rotated to control the cap advancing/retracting distance and adjust the rotational angle of the cam member. Therefore, the cap advancing/retracing distance can be easily adjusted by adjusting the cam member rotational angle.

In a sixth aspect of the invention, the gap indicating means has head gap settings for recording media and determines the head gap by the selection of the recording medium. The head gap detecting means detects the head gap upon receipt of the type of recording medium selected by the gap indicating means. Therefore, the head gap can be easily detected by only selecting the recording medium.

In a seventh aspect of the invention, the printer further comprises ink ejecting condition adjusting means for receiving signals from the head gap detecting means, for controlling signals to be applied to the print head, and for adjusting the ink ejecting condition. Since the ink ejecting condition is adjusted suitably for the head gap, good quality printing can be achieved.

In an eighth aspect of the invention, the printer further comprises paper feed means for feeding the recording medium appropriately according to a printing state and driving amount adjusting means for receiving signals from the head gap detecting means, for controlling the paper feed means, and for adjusting how much the paper feed means is driven for one line. The driving amount of the paper feed means is adjusted according to the type of recording medium and the feed of the recording medium is kept constant for each recording medium type. Therefore the optimum recording medium feed (paper feed) can be achieved and high quality printing with clear images can be maintained.

BRIEF DESCRIPTION OF THE DRAWINGS

Preferred embodiments of the invention will be described in detail with reference to the following figures wherein:

FIG. 11 is a table showing the output voltage, cam member rotational angle, print density, and the feeding amount per a carriage return;

DETAILED DESCRIPTION OF THE PREFERRED EMBODIMENTS

An ink-jet printer of a first embodiment of the invention will be described below with reference to the drawings.

Figure 1:
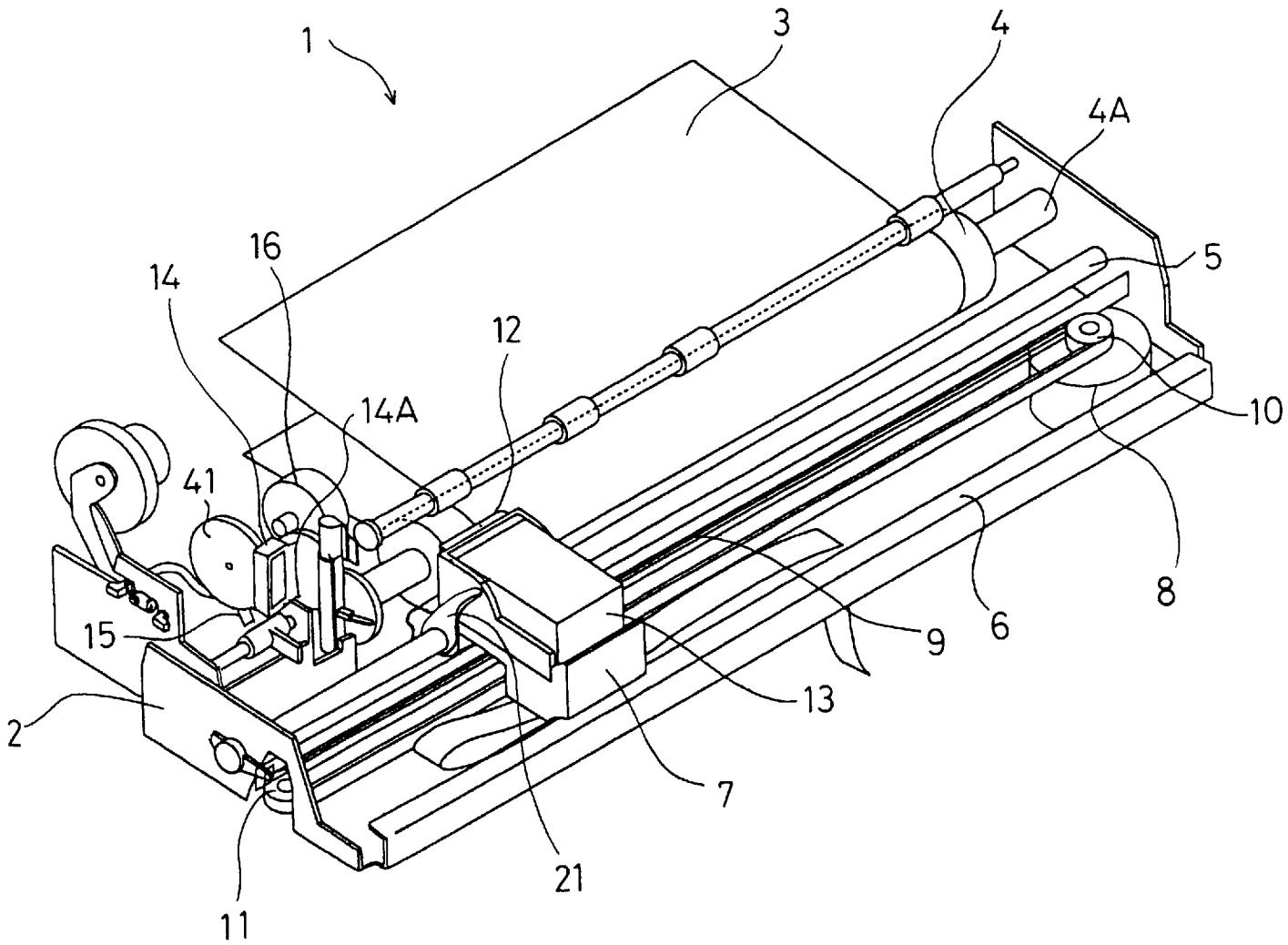
FIG. 1 is a perspective view showing a schematic structure of a printer of the preferred embodiment.
Figure 2:
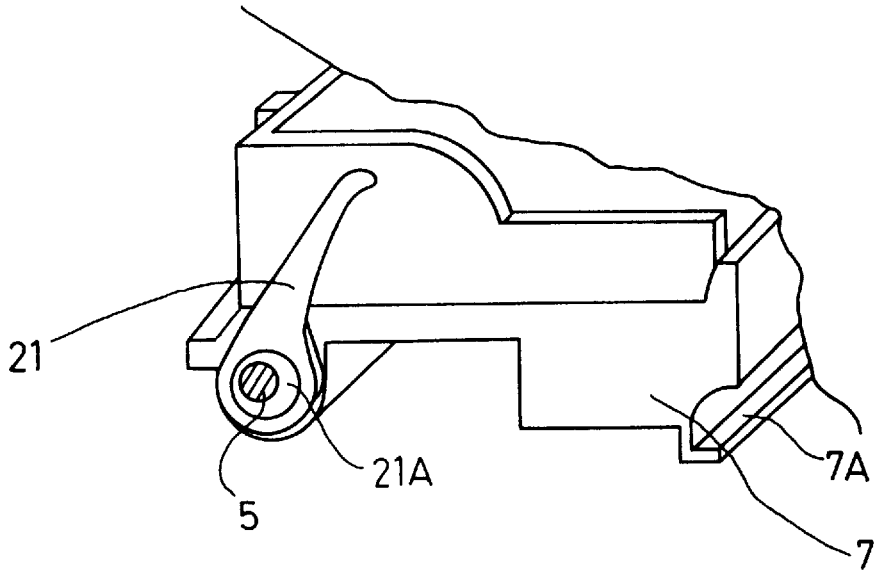
FIG. 2 is a perspective view of the carriage.

As shown in FIG. 1, an ink-jet printer 1 has a frame 2 on which a cylindrical platen roller 4 for feeding recording paper 3 is placed rotatably around a shaft 4A. A guide rod 5 is provided on the frame 2 in parallel with the platen roller 4. A carriage 7 is supported by the guide rod 5 so as to be able to reciprocate in parallel with the axis of the platen roller 4 and to rotate around the guide rod 5.

Figure 4:
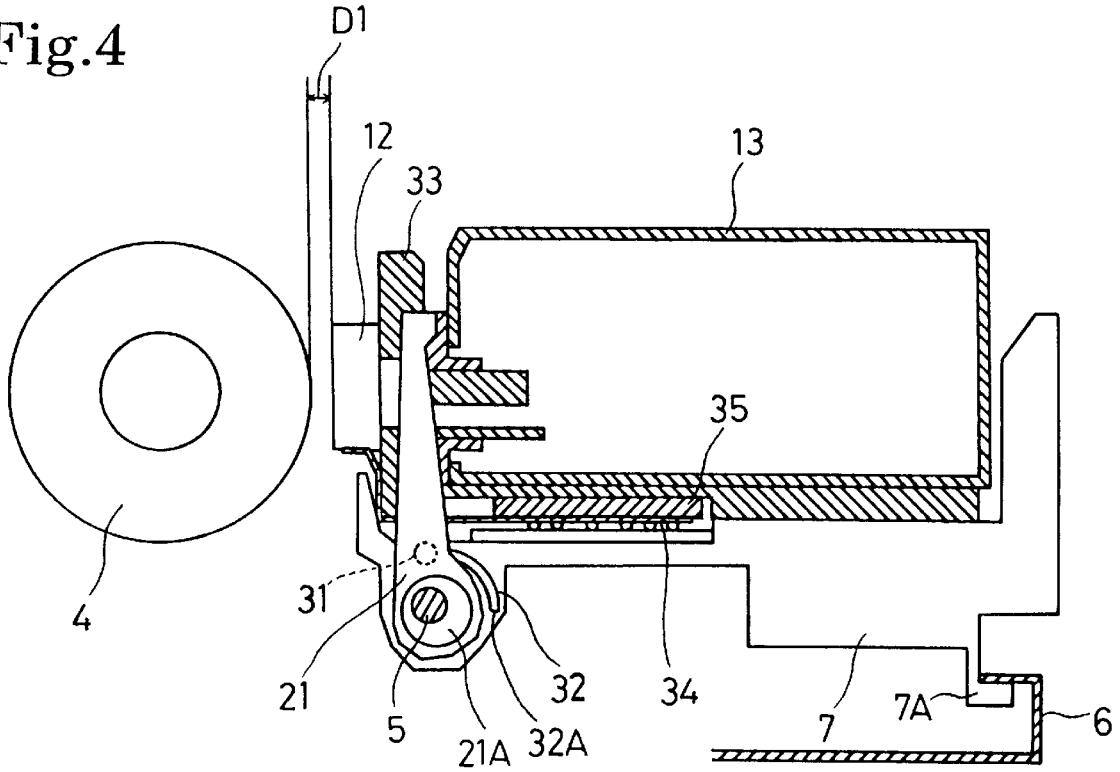
FIG. 4 is an illustrative diagram showing the head gap adjusting operation.
Figure 5:
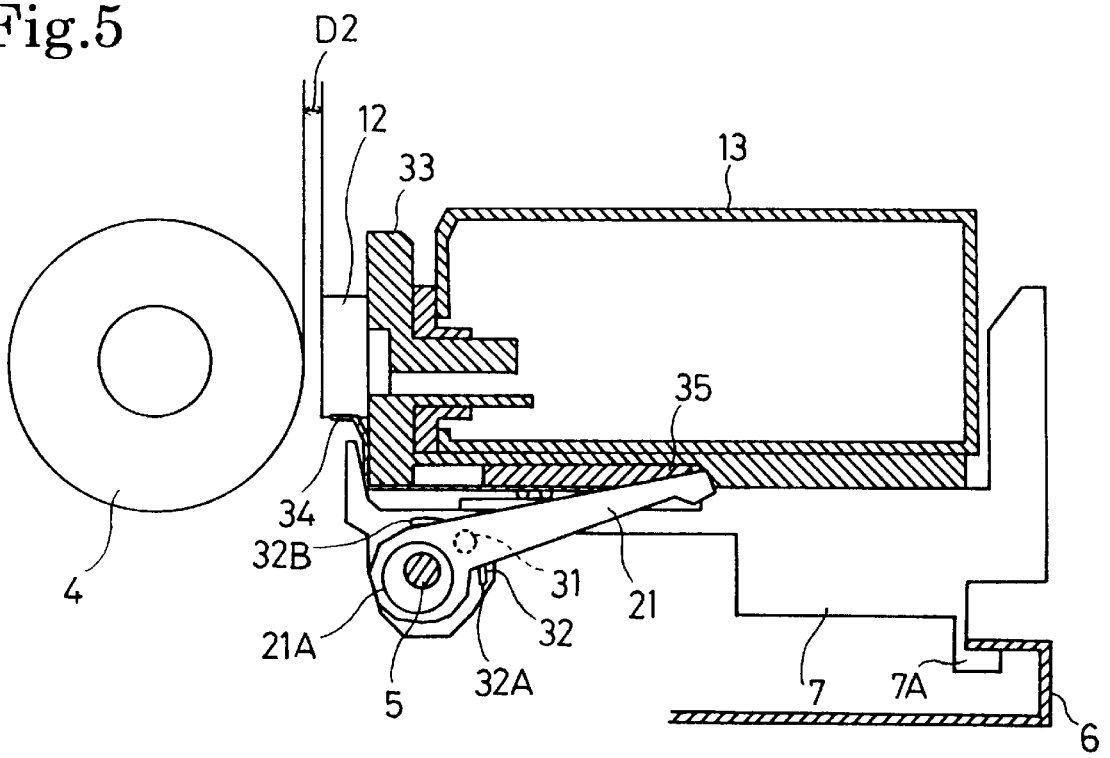
FIG. 5 is an illustrative diagram showing the head gap adjusting operation.

The carriage 7 is driven by a carriage motor 8 provided at the bottom of the frame 2 via a belt 9 and pulleys 10 and 11. An engaging portion 7A on the back bottom side of the carriage 7 engages with a guide plate 6 fixed to the frame 2 to hold the carriage 7 and a print head 12, mounted on the carriage 7, in certain positions. The carriage 7 is equipped with the print head 12 which ejects ink to the recording paper 3 to produce a printed record and a replaceable ink cartridge 13 which supplies ink to the print head 12. As shown in FIGS. 4 and 5, a head unit 33 equipped with the print head 12 and the ink cartridge 13 is mounted on the carriage 7, and print data is transmitted to the print head 12 by means of a flexible printed circuit board 34 (so-called dimple FPC). Provided between the ink cartridge 13 and the printed circuit board 34 is a backup rubber 35 for absorbing shock given by the moving carriage 7 to the printed circuit board 34.

Also mounted on the frame 2, as a recovery mechanism which recovers the print head from a poor ink ejection, are a suction cap 14 which hermetically covers a nozzle surface of the print head 12 and a suction pump 15 which is connected to the suction cap 14 and sucks and removes deteriorated ink through the suction cap 14.

In addition, a paper feed motor 16 which rotationally drives the platen roller 4 is mounted on the frame 2. The paper feed motor 16 is designed to rotationally drive a cam member 41 which controls the driving timing of the recovery mechanism switching the driving power transmitting mechanism.

Referring to FIGS. 2 through 5, described below is a gap adjusting mechanism.

As shown in FIGS. 2 through 5, an adjusting lever 21 is inserted eccentrically with reference to the guide rod 5 via an eccentric collar 21A. The eccentric collar 21A is slidably and rotatably fitted to the outer circumference of the guide rod 5 and rotatably supports the carriage 7 with a certain eccentricity so that the eccentric collar 21A operates integrally with the adjusting lever 21. The adjusting lever 21 and the eccentric collar 21A are so arranged to produce a certain eccentricity between the rotation center of the adjusting lever 21 and the rotation center of the eccentric collar 21A with reference to the carriage 7. With this arrangement, the adjusting lever 21 is rotated eccentrically via the eccentric collar 21A, and thereby the carriage 7 moves perpendicularly to the recording paper 3. On the side of the carriage 7 around the adjusting lever 21, a scale is marked corresponding to the thickness and type of recording paper 3. By setting a reference point provided in a predetermined position on the outer circumference of the adjusting lever 21 to an appropriate graduation, the carriage 7 can be moved to adjust the head gap according to the thickness and type of the recording paper 3. The setting of the adjusting lever 21 at a position marked on the side of the carriage 7 provides a gap indicating means.

Figure 3:
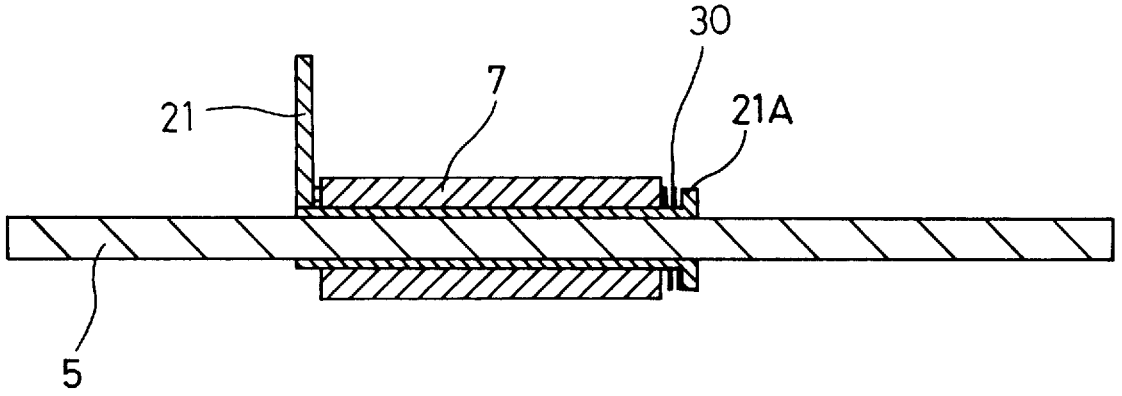
FIG. 3 is a cross-sectional view of the carriage.

As shown in FIG. 3, the adjusting lever 21 formed integrally with the eccentric collar 21A is urged to the carriage 7 by a spring member 30 provided between the carriage 7 and the eccentric collar 21A. Thus, the adjusting lever 21 can be held at any rotational angle. Although, in this embodiment, the head gap is adjusted by rotating the adjusting lever 21 by the operator, on alternate arrangement may be adopted, where a motor, instead of the adjusting lever 21, is driven according to the type of recording paper to be used to rotate the eccentric collar 21A by a predetermined angle and the eccentric collar 21A is held at a position to which it is rotated.

As shown in FIGS. 4 and 5, a contact member 31 is provided on a surface of the adjusting lever 21 opposed to the carriage 7, while on a surface of the carriage 7 opposed to the adjusting lever 21, a resistance member 32 is provided approximately arcuately along the path of the contact member 31 which is generated by rotation of the adjusting lever 21 and the corresponding movement of the carriage 7. The contact member 31 and the resistance member 32 are provided so as to make contact with each other, and their relative position is changed as the adjusting lever 21 is rotated. The voltage obtained based on the electrical resistance produced from the contact member 31 and the resistance member 32 when the adjusting lever 21 is rotated is detected as a rotational angle of the adjusting lever 21. In this way, the contact member 31 and the resistance member 32 detect the head gap based on the voltage obtained from the electrical resistance produced when the adjusting lever 21 is rotated.

As described above, the adjusting lever 21 is fitted to the guide rod 5 so that the center of the adjusting lever 21 and the center of the guide rod 5 are deviated from each other by means of the eccentric collar 21A. Consequently, when the adjusting lever 21 is rotated clockwise from a state shown in FIG. 4 to a state shown in FIG. 5, the adjusting lever 21 rotates about the axis of the guide rod 5 together with the eccentric collar 21A. Then, the carriage 7 moves horizontally toward the platen 4, and the head gap reduces from D1 shown in FIG. 4 to D2 shown in FIG. 5. Such adjustment of the head gap is disclosed in Japanese Unexamined Patent Publication No. 8-207388, the disclosure of which is incorporated herein by reference.

Figure 6:
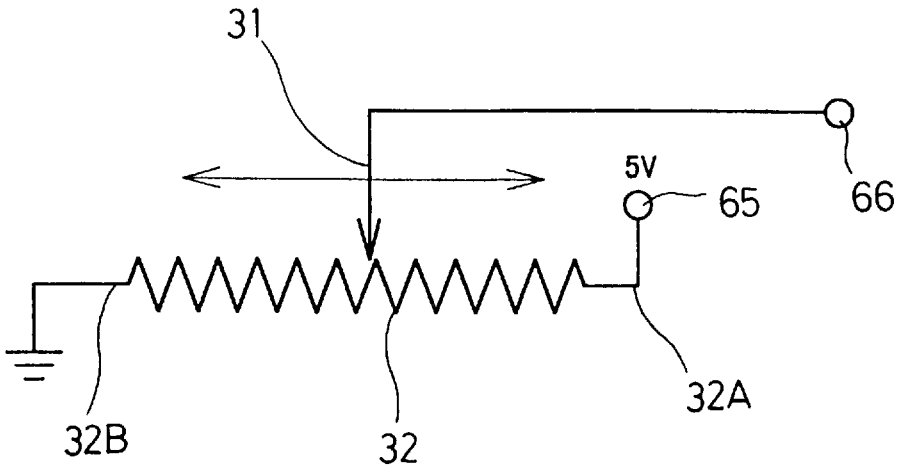
FIG. 6 is an illustrative diagram of a contact member and a resistance member.

Referring now to FIG. 6, described below is the contact member 31 and the resistance member 32. One end 32A, which is away from the print head 12, of the resistance member 32 is connected to a power source which outputs a current of 5 V and the other end 32B is grounded. The resistance depends on a point where the contact member 31 makes contact with the resistance member 32, and the voltage obtained from the resistance is output from an output portion 66 to a CPU 53 (refer to FIG. 9). For example, when the contact member 31 is in contact with the resistance member 32 at the end 32B, the resistance is increased and thus the voltage input to the output portion 66 is reduced. On the contrary, when the contact member 31 is in contact with the resistance member 32 at the end 32A, the resistance is reduced and thus the voltage input to the output portion 66 is increased.

Figure 10A:
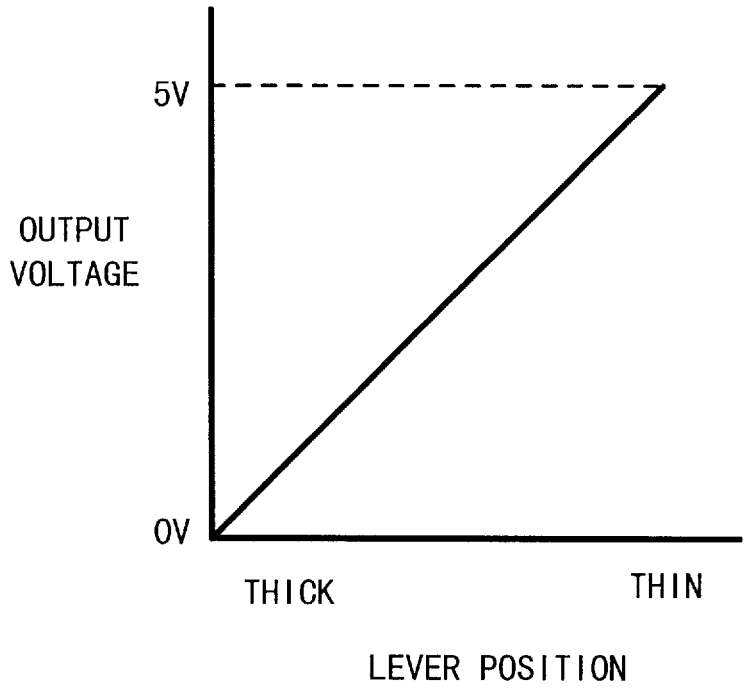
FIG. 10A is a graph showing the relationship, between the lever position set according to the recording paper type and the voltage output from the contact member.

As described above, when the adjusting lever 21 is rotated according to the thickness of the recording paper 3, the contact member 31 on the back of the adjusting lever 21 moves accordingly. As a result, the relative position of the contact member 31 and the resistance member 32 is changed, and accordingly the electrical resistance is changed. Shown in FIG. 10A is the change in relationship between the rotational position of the adjusting lever 21 and the output voltage input to the output portion 66 when the relative position between the contact member 31 and the resistance member 32 is changed.

The above relationship is described below in more detail. When the recording paper 3 is thick, the adjusting lever 21 is not rotated as shown in FIG. 4, and a large head gap is set. In this case, since the contact member 31 is in contact with the resistance member 32 at the end 32B, the resistance is increased and the voltage output from the output portion 66 is reduced. On the other hand, when the recording paper is thin, the adjusting lever 21 is rotated clockwise, as shown in FIG. 5, and a small head gap is set. In this case, since the contact member 31 is in contact with the resistance member 32 at the end 32A, the resistance is reduced and the voltage output from the output portion 66 is increased.

As described above, as the printing paper 3 becomes thicker, the electrical resistance becomes greater and the output voltage from the output portion 66 becomes smaller. On the contrary, as the printing paper 3 becomes thinner, the electrical resistance becomes smaller and the output voltage from the output portion 66 becomes greater. The output voltage to an A/D port of the CPU 53 varies in the range from 0 to 5 V. Thus, the CPU 53 uses the output voltage from the contact member 31 and the resistance member 32 to determine the head gap. The combination of elements comprises a head gap detecting means.

Figure 7:
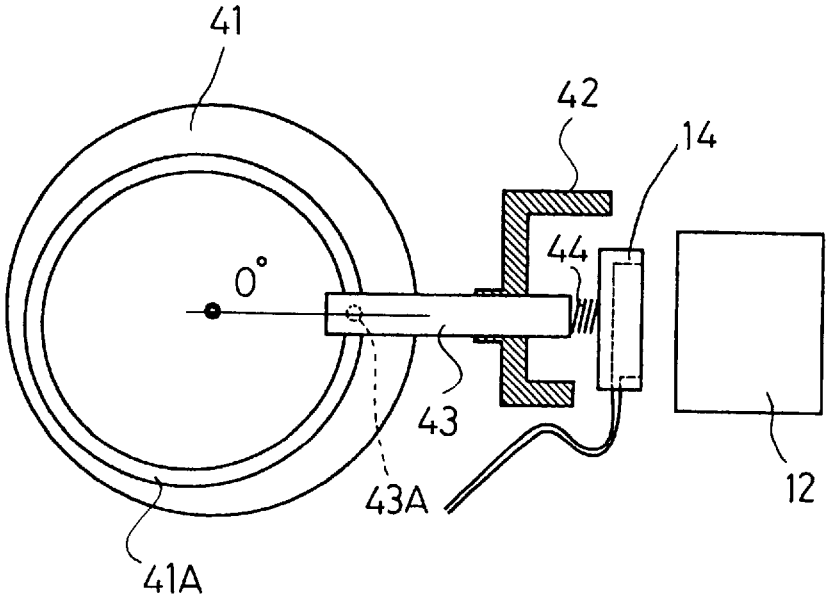
FIG. 7 is an illustrative diagram showing the operation of a suction cap.
Figure 8:
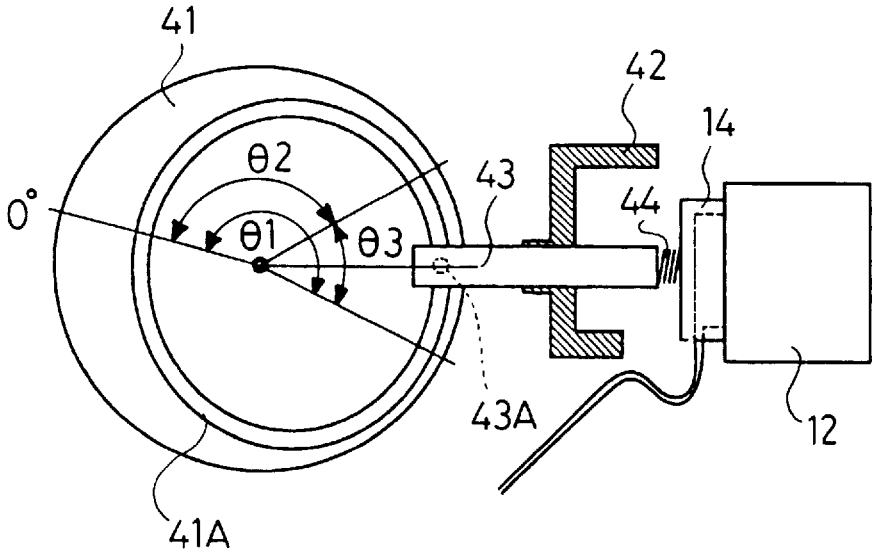
FIG. 8 is an illustrative diagram showing the operation of the suction cap.

Referring now to FIGS. 7 and 8, described below is the recovery mechanism.

The suction cap 14 is connected via a spring 44 to the front end of the rod member 43 which is fitted to a support member 42 so as to reciprocate. An engaging member 43A provided at the rear end of the rod member 43 movably engages with a cam groove 41A of a cam member 41 (capping mechanism). The cam groove 41A is provided eccentrically relative to the cam member 41. The cam member 41, when it rotates, changes the distance between the suction cap 14 and the print head 12 via the rod member 43 and the spring 44. That is, the rotational angle of the cam member 41 controls the advancing/retracting distance of the suction cap 14 to/from the print head 12. The cam member 41 is driven by a paper feed motor 16 and the rotational angle of the cam member 41 is adjusted by counting the number of driving pulses of the paper feed motor 16 (stepping motor).

Figure 9:
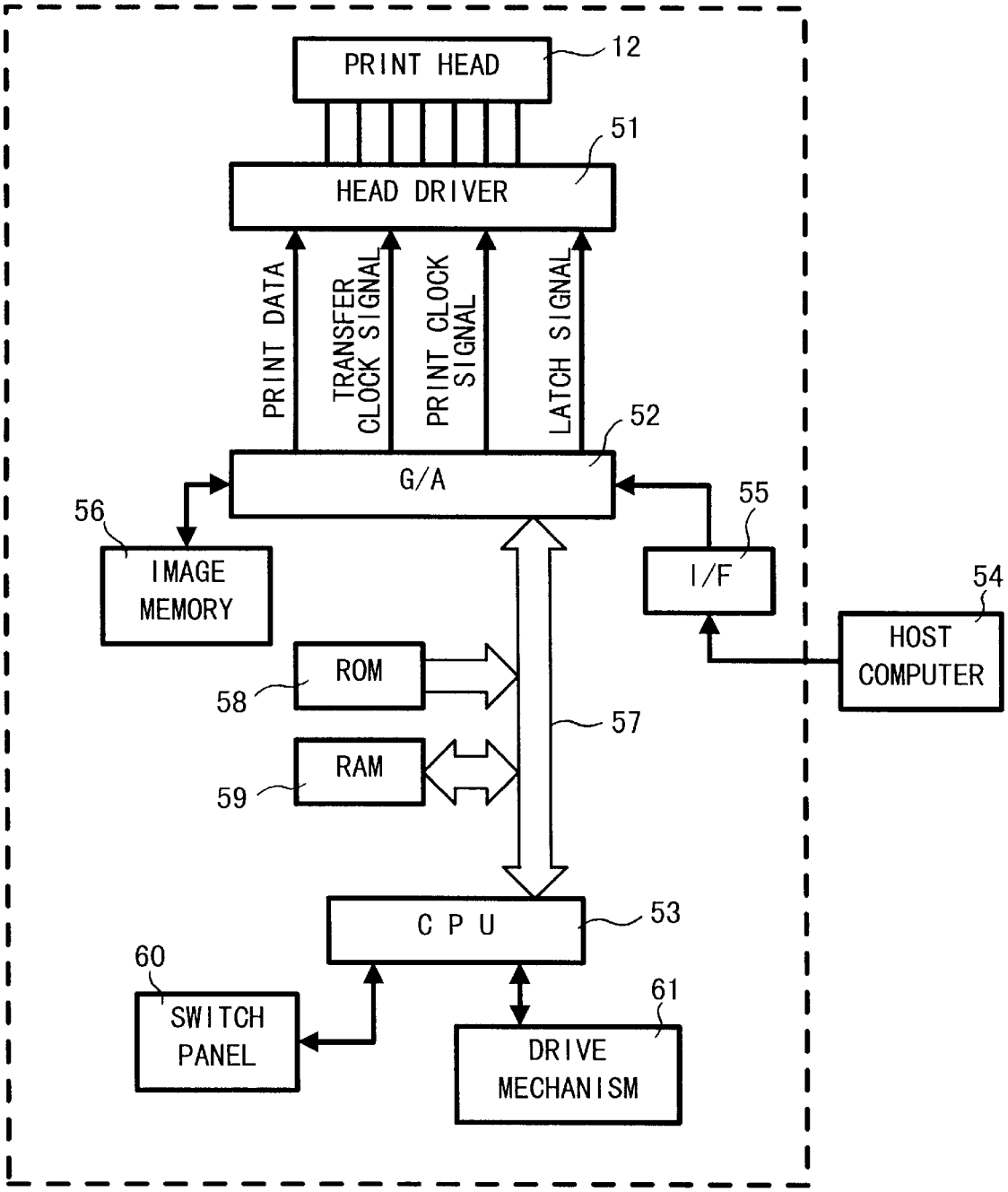
FIG. 9 is a schematic diagram showing a control mechanism of the printer of the embodiment of the invention.

Referring now to FIG. 9, the control mechanism comprises a head driver 51, a gate array 52, and a CPU 53. The head driver 51 is a circuit which applies drive signals to each channel of the print head 12. The gate array 52 is a circuit which receives print data (code data) from a host computer 54, such as a personal computer, via an interface 55 and develops the print data to the image data or transmits it to the head driver 51. The gate array 52 is provided with an image memory 56 which stores the developed image data.

The CPU 53 is a one-chip microcomputer controlling the entire operation of the printer. The CPU 53 and the gate array 52 are connected by a bus 57 and they transmit/receive data and timing signals to/from each other. The CPU 53 is also connected to a ROM 58 and a RAM 59 via the bus 57, and to a switch panel 60 where print parameters are set and displayed as well as to a drive mechanism 61 of mechanical parts. The drive mechanism 61 includes the contact member 31 and the resistance member 32 which detect the rotational angle of the adjusting lever 21, the carriage motor 8, the paper feed motor 16, and their position sensors.

Described below is how the CPU 53 controls the rotational angle of the cam member 41 according to the rotational angle of the adjusting lever 21.

Figure 10B:
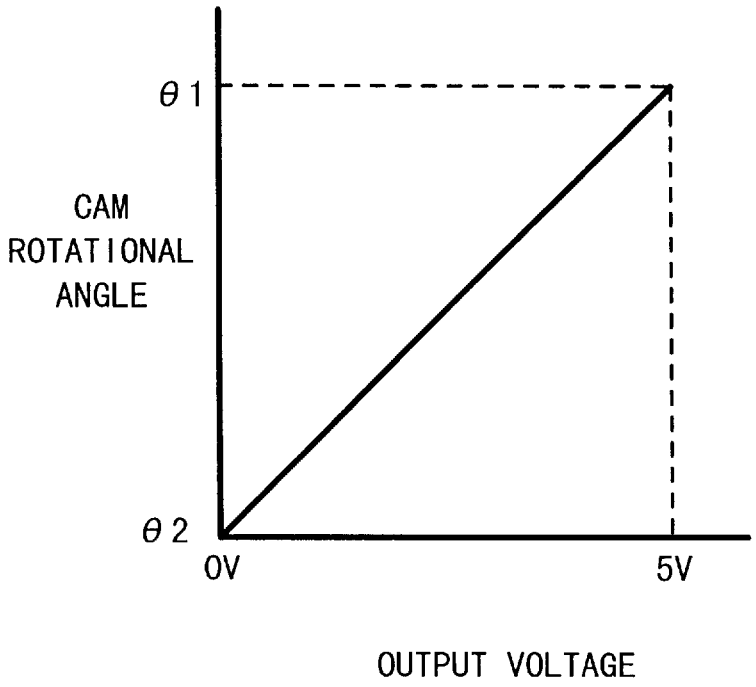
FIG. 10B is a graph showing the relationship, between the voltage output from the contact member and the cam member rotational angle.

As described above, the output voltage input to the output portion 66 varies in the range from 0 to 5 V depending on the rotational angle of the adjusting lever 21. The CPU 53 changes the rotational angle of the cam member 41 in the range from $\theta 2$ to $\theta 1$, that is, $\theta 3$ as shown in FIG. 8, in response to changes in output voltage in order to adjust the advancing/retracting distance of the suction cap 14 to/from the print head 12. Consequently, the advancing/retracing distance of the suction cap 14 to/from the print head 12 can be adjusted according to the thickness and type of the recording paper 3. Shown in FIG. 10B is the relationship between the output voltage input to the output portion 66 when the adjusting lever 21 is rotated and the rotational angle of the cam member 41. When the output voltage is 0 V, the rotational angle of the cam member 41 is $\theta 2$, and when the output voltage is 5 V, the rotational angle is $\theta 1$. In short, the output voltage and the rotational angle of the cam member 41 are in a direct proportional relationship. The relationship, shown in FIG. 11, between the output voltage input to the output portion 66 when the adjusting lever 21 is rotated and the rotational angle of the cam member 41 has previously been stored in the ROM 58.

Described below is the head gap adjustment and capping operation of the suction cap 14 for the ink-jet print structured as described above.

Firstly, the operator determines the type of recording paper 3 to be used, and then rotates the adjusting lever 21 to a graduation marked on the carriage 7 to adjust the head gap. For example, when plain paper is used, the adjusting lever 21 is rotated to a graduation for plain paper. At this time, an output voltage of 3.4 V calculated based on the resistance determined by the rotational position of the adjusting lever 21 is input to the output portion 66. Then, the CPU 53 calculates, based on the table shown in FIG. 11, the rotational angle $\theta 2+(\theta 1-\theta 2)\times 2/3$ of the cam member 41 from its reference position (rotational angle 0°) when the output voltage is 3.4 V. Subsequently, the cam member 41 is rotated based on the calculated rotational angle, and thereby the head gap and the distance between the suction cap 14 and the print head 12 can be adjusted suitably for the thickness and type of the recording paper 3 to be used. The CPU 53, cam member 41, and the paper feed motor 16 form a cap position adjusting means. Therefore, even when the head gap is changed according to the recording paper 3, the recovery operation by the suction cap 41 can be performed effectively. Moreover, the suction cap 14 can cover the nozzle surface of the print head 12 in approximately the same condition regardless of the thickness and type of recording paper 3, enabling an effective recovery operation.

When the adjusting lever 12 is not precisely aligned with a graduation, then in the preferred embodiment, the CPU 53 adjusts the output voltage to one of the specified voltages closest to that determined, i.e., 0, 1.7, 3.4 or 5 V. Alternatively, an interpolation routine could be provided that would adjust the head gap based upon the actual resistance measured.

Referring now to FIGS. 12 through 15, a second embodiment of the invention will be described. Description of the same structure as that in the first embodiment is omitted and the same parts as those in the first embodiment are given the same reference numbers.

Figure 12:
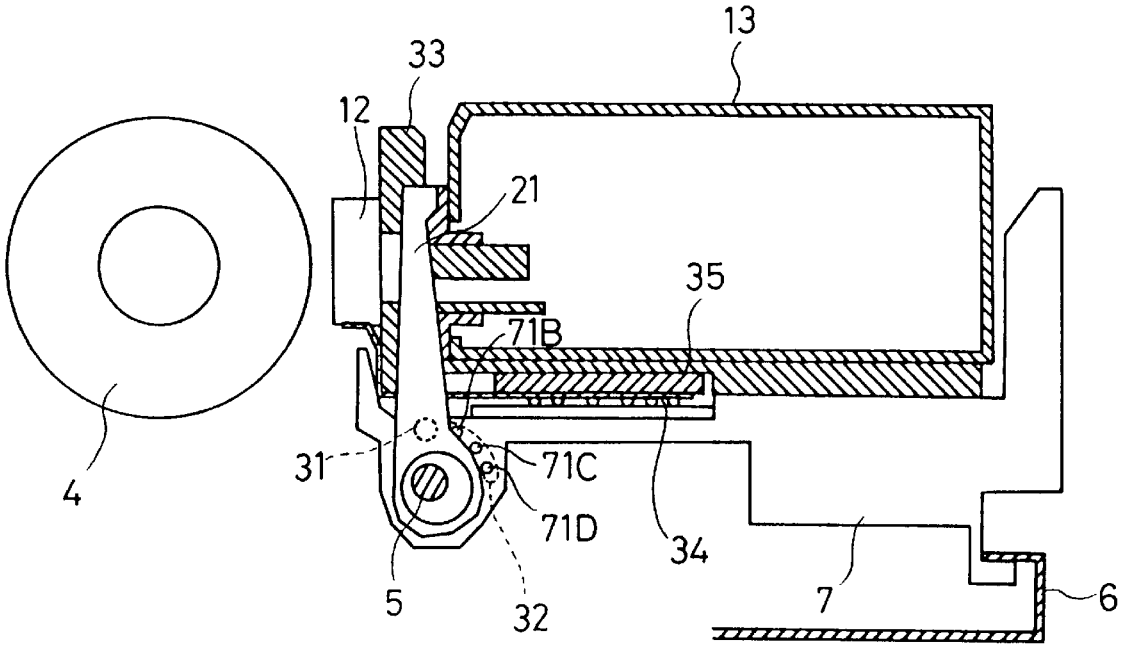
FIG. 12 is an illustrative diagram showing the head cap adjusting operation in a second preferred embodiment.
Figure 13:
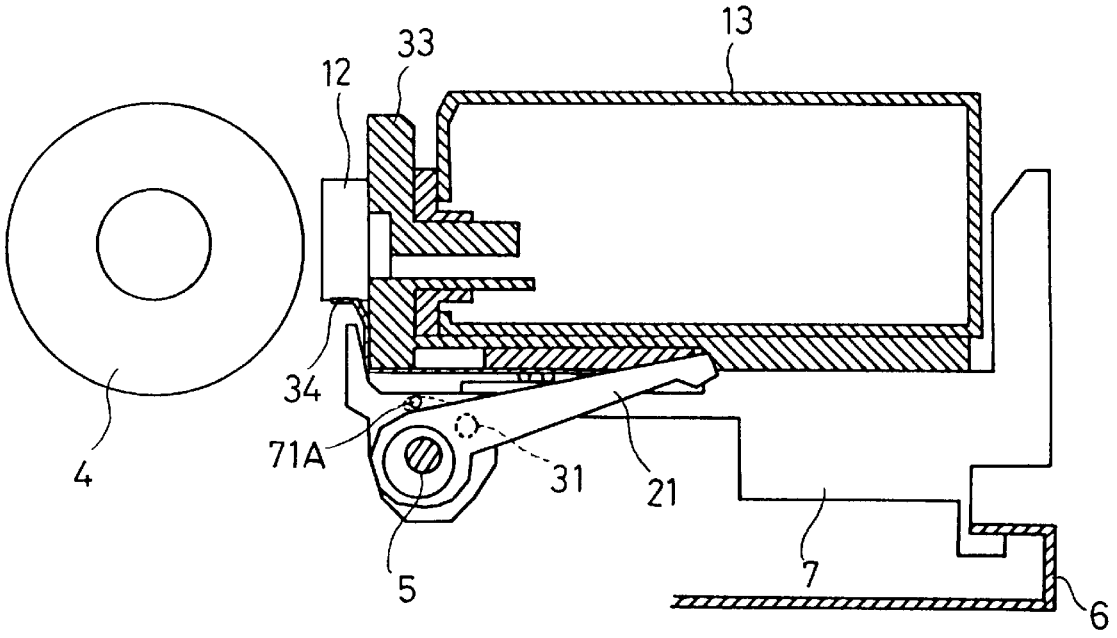
FIG. 13 is an illustrative diagram showing the head cap adjusting operation in the second embodiment.
Figure 14:
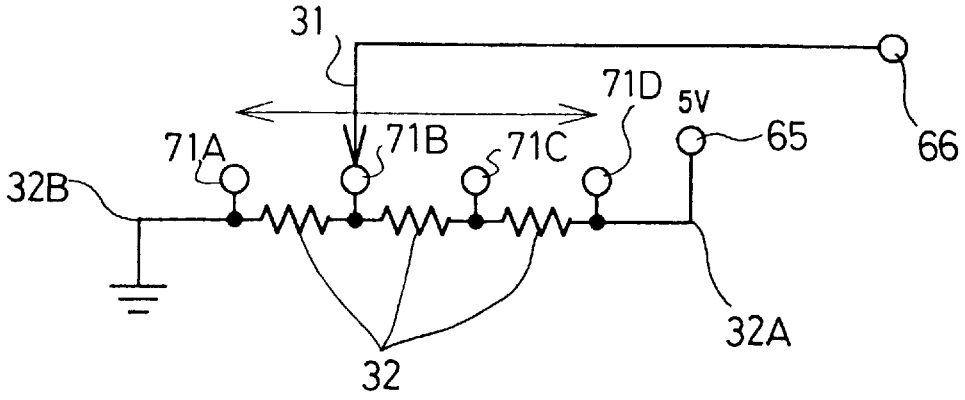
FIG. 14 is an illustrative diagram of a contact member and a resistance member in the second embodiment.
Figure 15:
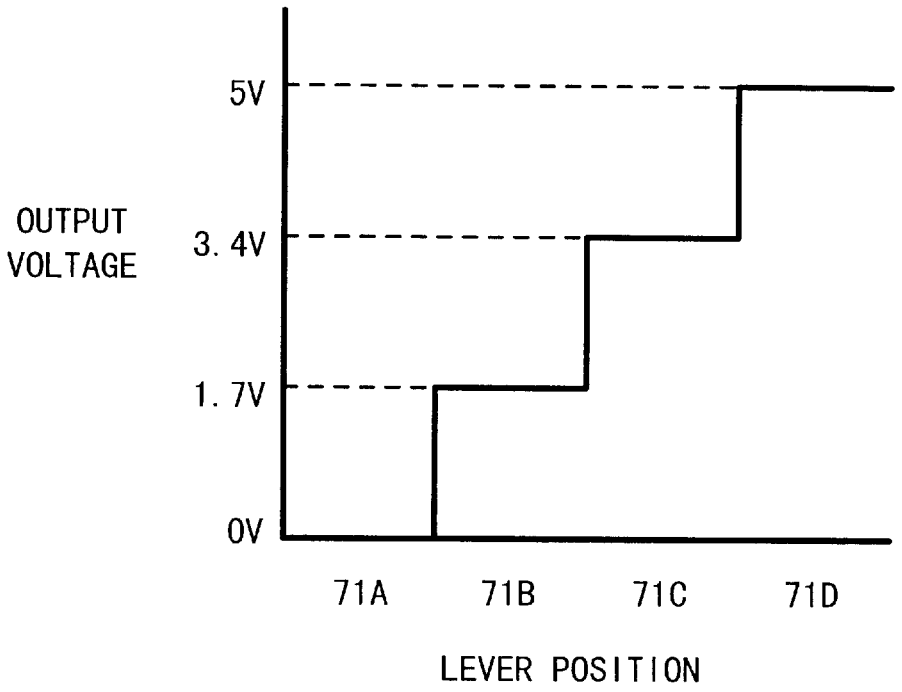
FIG. 15 is a graph showing the relationship between the lever position set according to the recording paper type and the voltage output from the contact member.

In the second embodiment, as shown in FIGS. 12–14, four contact portions 71A, 71B, 71C, and 71D which are part of the resistance member 32 are provided on the side of a carriage 7 so as to make contact with a contact member 31. The four contact portions 71A, 71B, 71C, and 71D are provided approximately arcuately along the path of the contact portion which is generated by rotation of the adjusting lever 21 and the corresponding movement of the carriage 7. Since the contact member 31 is formed to be convex and the four contact portions 71A, 71B, 71C, and 71D are formed to be concave so that each of the concave contact portions engages with the convex contact member 31, the adjusting lever 21 is fixed at each contact portion. The contact portion 71A is disposed to correspond to an envelope, 72B to OHP sheet, 71D to plain paper, and 71D to tracing paper. In the second embodiment, since the contact member 31 makes contact with the resistance member 32 at any one of the contact portions 71A, 71B, 71C, and 71D, the relationship between the rotational position of the adjusting lever 21 and the output voltage, which is input to an output portion 66 when the relative position of the contact member 31 and the resistance member 32 is changed, is changed as shown in FIG. 15.

Referring now to FIG. 14, described below is the resistance member 32 in the second embodiment.

In the same way as in the first embodiment, one end 32A of the resistance member 32 is connected to a power source which outputs a current of 5 V while the other end 32B is grounded. The resistance depends on which one of the contact portions 71A, 71B, 71C, and 71D makes contact with the contact member 31, and the output voltage obtained by the resistance is output from the output portion 66 to a CPU 53. As apparent from FIG. 15, the output voltage is 0 V, 1. 7 V, 3.4 V, and 5 V, respectively, when the contact member 31 makes contact with the contact portions 7A, 71B, 71C, and 71C. In a word, the output voltage steps up.

Described below is the operation of the ink-jet printer in the second embodiment.

Firstly, the operator determines the type of recording paper 3 to be used, and then rotates the adjusting lever 21 to the contact portion 71A, 71B, 71D, or 71D according t the type of recording paper 3 to adjust the head gap. For example, when tracing paper is used, the adjusting lever 21 is rotated to the contact portion 71D to engage the convex of the contact member 31 of the adjusting lever 21 with the concave of the contact portion 71D and to fix the adjusting lever 21. The capping operation by the suction cap 14 based on adjustment of the head gap is the same as in the first embodiment, and the same effects as those obtained in the first embodiment are also obtained in the second embodiment.

Properties such as the extent of ink blurring, extent of ink fixation, and ink drying speed vary depending on the type of recording paper 3. Thus, it is desirable to eject ink in a condition suitable for the properties of the recording paper 3. Printing using the same amount of ink constantly without considering the properties of the recording paper 3 may cause the ink to blur or streak on the printing paper, resulting in ink stains on the print head and the paper feed roller.

To avoid the above problem, in a third embodiment of the invention, signals applied to a print head 12 according to the output voltage input from a contact member 31 to a CPU 53 via an output portion 66 are controlled to adjust the ink ejecting condition (amount of ink to be ejected). Since the output voltage corresponds to the type of recording paper 3, the ink amount can be adjusted according to the type of recording paper 3. Referring to FIG. 11, specific cases are explained based on a case where normal paper is used. Firstly, when an envelope where usually monochrome, relatively large-sized characters are printed is used, more ink is ejected than when a plain paper is used. When OHP sheet or tracing paper which does not absorb ink is used, less ink is ejected than when a plain paper is used. With this arrangement, since the amount of ink to be ejected is adjusted according to the type of recording paper 3, whichever type of recording paper is used, no ink blurs or streaks due to poor ink fixation occur and good quality printing can be achieved.

Furthermore, since other properties, such as the surface friction and rigidity, vary depending on the type of recording paper 3, if different types of recording paper are fed in the same condition, they vary in feed. Thus, it is desirable to feed recording paper 3 in a condition suitable for its properties and to eliminate feed variations in each type of recording paper 3.

For the reason described above, in a fourth embodiment of the invention, how much the platen roller 4 is driven at a time can be adjusted according to the recording paper 3 to be used based on the output voltage input from a contact member 31 to a CPU 53 via an output portion 66. Consequently, whichever type of recording paper 3 is used, no variations in paper feed are produced and the actual feed of the recording paper 3 can be kept constant in each recording paper type.

Referring to FIG. 11, specific cases are explained based on a case where a plain paper is used. Firstly, when an envelope, which is folded and therefore less even on the surface than plain paper and susceptible to a carriage return failure, is used, the feeding amount per carriage return is set to be 0.5 mm and smaller than when plain paper is used. When OHP sheet which is slippery on the surface and extremely hard to feed is used, the feeding amount per carriage return is set to be 0.25 mm and much smaller than when plain paper is used. When tracing paper which is thinner and less rigid than plain paper and hard to feed is used, the feeding amount per carriage return is set to be 0.5 mm and smaller than when plain paper is used. With this arrangement since the paper feeding amount is adjusted according to the type of recording paper 3 to be used, whichever type of recording paper 3 is used, no variations in paper feed are produced in each recording paper type.

In the above described embodiments, the advancing/retracting distance of the suction cap 14 to/from the print head 12, the amount of ink to be ejected, and the paper feeding amount are adjusted based on the output voltage which is obtained by adjusting the head gap according to the type of recording paper 3 to be used. As a result, whichever type of recording paper 3 is used, recovery operation of the print head can be performed effectively and good quality printing can be achieved without variations in paper feed, ink blurring, or ink streaking. It is needless to say that a combination of the first or second, and the third, and/or fourth embodiments will enhance the effects.

It is to be understood that the invention is not restricted to the particular forms shown in the foregoing embodiments. Various modifications and alterations can be made thereto without departing from the scope of the invention encompassed by the appended claims.

What is claimed is:

1. A printer, comprising:

a print head which ejects ink to a recording medium;

a capping mechanism which has a cap hermetically covering a nozzle surface of said print head and being capable of moving the cap into contact with the nozzle surface of said print head in such a manner that the cap can advance/retract to/from said print head;

gap indicating means for indicating a head gap which is an interval between said print head and the recording medium;

a gap adjusting mechanism adjusting the head gap to the indicated head gap indicated by said gap indicating means;

head gap detecting means for detecting the head gap indicated by said gap indicating means;

cap position adjusting means for receiving signals of the head gap from said head gap detecting means, said cap position adjusting means for adjusting the cap advancing/retracting distance based on the received signals of the head gap.

2. The printer as claimed in claim 1, wherein the cap is a suction cap, and further comprising a recovery unit which removes ink by suction from said print head by contacting the suction cap with the nozzle surface of said print head.

3. The printer as claimed in claim 1, wherein said gap indicating means is an adjusting lever whose rotational angle determines the head gap, and said gap adjusting mechanism includes a cam mechanism which interlocks the adjusting lever and advances/retracts said print head to/from the recording medium.

4. The printer as claimed in claim 3, wherein said head gap detecting means detects a rotational angle of the adjusting lever as an electrical resistance and detects the head gap based on the electrical resistance.

5. The printer as claimed in claim 1, wherein said cap position adjusting means has a cam member linked with the cap which rotates to control the cap advancing/retracting distance, the rotational angle of the cam member adjusted based on the rotational angle of the adjusting lever.

6. The printer as claimed in claim 1, wherein said gap indicating means has head gap settings for various recording media.

7. The printer as claimed in claim 1, further comprising ink ejecting condition adjusting means for receiving signals from said head gap detecting means, for controlling signals to be applied to the print head, and for adjusting the ink ejecting condition.

8. The printer as claimed claim 1, further comprising paper feed means for feeding the recording medium appropriately according to a printing state and driving amount adjusting means for receiving signals from said head gap detecting means, for controlling the paper feed means, and for adjusting how much the paper feed means is driven at a time.

9. A printer, comprising:

a print head which ejects ink to a recording medium;

a capping mechanism which has a cap hermetically covering a nozzle surface of said print head and capable of moving the cap into contact with the nozzle surface of said print head in such a manner that the cap can advance/retract to/from said print head;

gap indicating means for indicating a head gap which is an interval between said print head and the recording medium;

a gap adjusting mechanism adjusting the head gap to the indicated head gap indicated by said gap indicating means;

head gap detecting means for detecting the head gap indicated by said gap indicating means; and control means for receiving signals of the head gap from said head gap detecting means, said control means for controlling at least one of adjustment of the cap advancing/retracting distance, an amount of ejecting ink from said print head and a feeding amount of a recording medium by recording medium feeding means based on the received signals of the head gap.

10. A print head adjustment and cleaning mechanism for a printer having a CPU controlling printer operation and a print carriage mounted on a guide rod by means of a cylindrical opening the print carriage moving parallel to an opposing platen, comprising:

an eccentric collar mounted on the guide rod and received in the cylindrical opening of the carriage;

an adjusting lever attached to an end of the eccentric collar;

a resistance member mounted to a side of the carriage facing the adjusting lever;

a contact member on a surface of the adjusting lever and in contact with the resistance member;

a cleaning mechanism adjustment member; and a suction cap attached to the cleaning mechanism adjustment member for engaging and sealing the print head at a cleaning position, wherein movement of the adjusting lever causes the eccentric collar to rotate adjusting a gap between the print head and the platen and an output signal based on a point of contact between the contact member and the resistance member determines a drive distance between the suction cap and the print head for the suction cap to engage the print head.

11. The print head adjustment and cleaning mechanism as claimed in claim 10, wherein the resistance member is arcuate.

12. The print head adjustment and cleaning mechanism as claimed in claim 11, further comprising a plurality of graduations marked on the side of the carriage facing the adjusting lever associated with the resistance member, each graduation representing a type of printing medium usable with the printer.

13. The print head adjustment and cleaning mechanism as claimed in claim 11, wherein the resistance member has a plurality of indentations, the contact member respectively engaging each indentation, each indentation representing a type of print medium that can be used with the printer.

14. The print head adjustment and cleaning mechanism as claimed in claim 11, wherein the output signal produced as a result of the relative position of the contact member on the resistance member is used by the printer CPU to determine print density and feed amount per carriage return.

15. The print head adjustment and cleaning mechanism as claimed in claim 11, further comprising a 5 volt power source connected at one end of the resistance member and the other end of the resistance member is grounded, the contact member having an output portion connected to the CPU of the printer.

16. The print head adjustment and cleaning mechanism according to claim 15, wherein the output signal varies between 0 and 5 volts.

17. The print head adjustment and cleaning mechanism as claimed in claim 16, wherein when the output voltage is 0 volts a rotational angle of the cam member is a first angle and when the output voltage is 5 volts, the rotational angle is a second angle.

18. The print head adjustment and cleaning mechanism according to claim 17, wherein the first angle is less than the second angle.

19. The print head adjustment and cleaning mechanism as claimed in claim 10, wherein the cleaning mechanism adjustment member, comprises:

a cam member having an eccentric annular cam groove;

a rod member having an engaging member at one end engaging the cam groove and mounting the suction cap at the other end, wherein the rod member is received in a support member at an intermediate portion of the rod member between the engaging member and the suction cap, the support member attached to the printer.

20. The print head adjustment and cleaning mechanism as claimed in claim 19, further comprising a resilient member between the suction cap and the end of the rod member mounting the suction cap.

21. A printing apparatus, comprising:

a print head for printing onto a recording medium by jetting ink;

a carriage on which the print head is mounted, the carriage being provided movably along a guide rail;

a capping mechanism having a cap for air-tightly covering a nozzle surface of the print head, the capping mechanism making the cap come into contact with the nozzle surface of the print bead;

a gap adjusting mechanism for adjusting an amount of a head gap between the print head and the recording medium; and gap detecting means for detecting the head gap between the printhead and the recording medium set by the gap adjusting mechanism;

a capping mechanism moving mechanism for moving the capping mechanism in response to a signal received from the gap detecting mechanism with respect to the print head prior to activation of the capping mechanism.

22. The printing apparatus as claimed in claim 21, herein the cap is a suction cap, and further comprising a recovery unit which removes ink by suction from the print head by contacting the suction cap with the nozzle surface of the print head.

23. The printing apparatus as claimed in claim 21, wherein the capping mechanism is connected to a purging mechanism for sucking ink in the print head in relation to the capping mechanism.

24. The printing apparatus as claimed in claim 21, wherein the carriage further comprises a slidable attachment mechanism for attaching an end of the carriage to the printer in addition to the carriage being movably mounted to the guide rail.

* * * * *